US007213913B2

(12) United States Patent
Sakai et al.

(10) Patent No.: US 7,213,913 B2
(45) **Date of Patent: *May 8, 2007**

(54) INK CARTRIDGE

(75) Inventors: Yasuto Sakai, Nagano (JP); Hisashi Miyazawa, Nagano (JP); Satoshi Shinada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/931,765

(22) Filed: Sep. 1, 2004

(65) Prior Publication Data

US 2005/0030357 A1 Feb. 10, 2005

Related U.S. Application Data

(63) Continuation of application No. 10/150,479, filed on May 17, 2002, now Pat. No. 6,945,641.

(30) Foreign Application Priority Data

May 17, 2001 (JP) ..... P2001-148296
May 18, 2001 (JP) ..... P2001-149786

(51) Int. Cl.
*B41J 2/175* (2006.01)

(52) U.S. Cl. ..... 347/86

(58) Field of Classification Search ..... 347/85, 347/86, 87

See application file for complete search history.

(56) References Cited

U.S. PATENT DOCUMENTS 4,419,677 A 12/1983 Kasugayama et al.
4,460,905 A * 7/1984 Thomas ..... 347/54
4,555,719 A 11/1985 Arway et al.
4,677,447 A 6/1987 Nielsen
5,025,271 A 6/1991 Baker et al.
5,280,300 A 1/1994 Fong et al.
5,453,772 A 9/1995 Aono et al.
5,583,549 A 12/1996 Ujita et al.
5,721,576 A 2/1998 Barinaga
5,732,751 A 3/1998 Schmidt et al.
5,777,647 A 7/1998 Pawlowski, Jr. et al.
5,801,737 A 9/1998 Sato et al.
5,847,735 A 12/1998 Betschon et al.
5,900,895 A 5/1999 Merrill
6,000,788 A 12/1999 Iida (Continued)

FOREIGN PATENT DOCUMENTS

EP 0 794 059 9/1997

(Continued)

OTHER PUBLICATIONS

U.S. Appl. No. 09/525,477, unpublished, Miyazawa.

(Continued)

*Primary Examiner*—Anh T. N. Vo
(74) *Attorney, Agent, or Firm*—Stroock & Stroock & Lavan LLP

(57) ABSTRACT

In an ink cartridge (1), an opening of an ink low groove 35 and an opening of an atmosphere communication recess 36 are formed in the front surface of a container main body (2), and sealed by a film (57), thereby constituting flow paths.

27 Claims, 11 Drawing Sheets

U.S. PATENT DOCUMENTS

| | | | |
|---|---|---|---|
| 6,010,211 | A | 1/2000 | Betschon |
| 6,022,102 | A | 2/2000 | Ikkatai et al. |
| 6,193,364 | B1 | 2/2001 | Iida |
| 6,299,296 | B2 | 10/2001 | Gasvoda |
| 6,332,481 | B1 | 12/2001 | Shinada et al. |
| 6,416,152 | B1 | 7/2002 | Matsuzaki et al. |
| 6,422,691 | B2 | 7/2002 | Kobayashi et al. |
| 6,585,358 | B2 | 7/2003 | Usui et al. |
| 2001/0020971 | A1 | 9/2001 | Usui et al. |
| 2002/0109760 | A1 | 8/2002 | Mivazawa et al. |
| 2002/0158948 | A1 | 10/2002 | Miyazawa et al. |
| 2003/0128261 | A1 | 7/2003 | Usui et al. |
| 2005/0057626 | A1 | 3/2005 | Usui et al. |
| 2005/0134661 | A1 | 6/2005 | Miyazawa |

FOREIGN PATENT DOCUMENTS

| | | | |
|---|---|---|---|
| EP | 0 794 059 | A2 | 9/1997 |
| EP | 0 827 836 | A1 | 3/1998 |
| EP | 0 963 847 | A1 | 12/1999 |
| EP | 1 016 533 | A1 | 7/2000 |
| EP | 1 125 747 | A2 | 8/2001 |
| EP | 1 199 178 | A1 | 4/2002 |
| EP | 1 199 179 | A1 | 4/2002 |
| JP | 04-144755 | A | 5/1992 |
| JP | 5-8404 | A | 1/1993 |
| JP | 09-109406 | A | 4/1997 |
| JP | 09-207352 | A | 8/1997 |
| JP | 9-272210 | A | 10/1997 |
| JP | 10-58696 | A | 3/1998 |
| JP | 11-5311 | A | 1/1999 |
| JP | 2000-33708 | | 2/2000 |
| JP | 2000-062205 | A | 2/2000 |
| JP | 2000-301740 | A | 10/2000 |
| JP | 2001-341324 | A | 12/2001 |
| WO | WO 00/03877 | A1 | 1/2000 |

OTHER PUBLICATIONS

U.S. Appl. No. 11/317,928, filed Dec. 23, 2005, Miyazawa.
Office Action in Japanese Patent Appln. 2001-99531 (Dec. 17, 2005).
Examination Report for European patent appln. 02 010 258.8 (Sep. 29, 2006).

* cited by examiner

INK CARTRIDGE

CROSS-REFERENCE TO RELATED APPLICATION

This application is a continuation of application Ser. No. 10/150,479, filed on May 17, 2002 now U.S. Pat. No. 6,945,641.

BACKGROUND OF THE INVENTION

The present invention relates to an ink cartridge for use with an ink-jet recording apparatus, which supplies ink to a recording head for ejecting ink droplets in response to a print signal.

An ink-jet recording apparatus is generally constituted such that an ink-jet recording head for ejecting ink droplets in response to a print signal is mounted on a carriage which travels back and forth in a widthwise direction of recording paper and such that ink is supplied to the recording head from an external ink tank. In the case of a compact recording apparatus, an ink reservoir like the ink tank is removably provided on a carriage. In the case of a large recording apparatus, an ink reservoir is set in a casing and connected to a recording head by an ink supply tube.

As an ink cartridge to be set on a carriage, such types are available, that a porous member, such as a sponge, impregnated with ink is accommodated within an ink cartridge, and that only ink is stored in an ink cartridge, and a differential pressure regulating valve is disposed in the vicinity of a supply port of an ink storage section.

These types of ink cartridges can maintain ink pressure exerted on nozzle openings of a recording head at a predetermined level using the porous material or the differential pressure regulating valve, thereby preventing leakage of ink from the nozzle openings.

The present invention relates to the ink cartridges as described above, and aims at providing an ink cartridge which enables easy formation of a comparatively-complicated flow path such as an ink flow path and an atmosphere communication path.

SUMMARY OF THE INVENTION

To achieve the object, the invention provides an ink cartridge for use with an ink-jet recording apparatus in which ink is stored in a container having an ink supply port, wherein an ink flow recess defining an ink flow path is formed in a surface of the container, and an atmosphere communication recess defining an atmosphere communication path is formed in the surface of the container; and an opening of the ink flow recess and an opening of the atmosphere communication recess in the surface of the container, are sealed by a film, thereby constituting the ink flow path by the ink recess and the atmosphere communication path by the atmosphere communication recess.

According to the ink cartridge of the invention, the ink flow recess and atmosphere communication recess are formed in the surface of the container, and openings of these recesses are sealed by the film, thus constituting flow paths. Hence, it is possible to readily form a container having comparatively complicated flow path, such as the ink flow path and the atmosphere communication path. Therefore, designing and machining of a molding die are facilitated, thereby enabling lower-cost manufacture of an ink cartridge.

When the opening of the ink flow recess and the opening of the atmosphere communication recess are sealed with a single film, the number of films is not increased unduly, and hence the ink cartridge of the invention is advantageous in terms of cost.

When the opening of the ink flow recess and the opening of the atmosphere communication recess are sealed by welding the film onto the surface of the container, the ink flow recess and the atmosphere communication recess are sealed by means of welding of the film. Hence, manufacture of an ink cartridge is facilitated.

When the surface of the container is roughly divided into a region where primarily the ink flow recess is formed and another region where primarily the atmosphere communication recess is formed, and/or when a welding region of the film is divided into a region in which primarily the atmosphere communication recess is formed and another region, a further advantage can be obtained. That is, since precision for welding height is required for the opening of the atmosphere communication recess defining the atmosphere communication path, the region where the atmosphere communication recess is formed can be welded separately from the other region, thereby facilitating management of height precision in welding. It is possible to control the welding status only for a relatively small area. Hence, setup of requirements for welding can also be performed comparatively readily.

When the welding region of the film is divided into a region which primarily requires management of precision for welding height and another region which primarily requires management of welding strength, a height for welding can be accurately managed in the region which requires precision for welding height. Further, welding strength can be managed so as to be enhanced in the region which requires management of welding strength. Thus, management of welding precision and management of welding strength can be performed simultaneously.

When the ink cartridge further comprises a negative pressure generation system for generating negative pressure in the cartridge, and/or when a welding region of the film is divided into a region which is formed with the ink flow recess defining an ink flow path located downstream of the negative pressure generation system, and another region, since the cartridge having the negative pressure generation system involves the ink flow path and atmosphere communication path having comparatively-complicated geometries, the invention's advantage of the ability to readily form complicated flow paths is noticeable and effective.

When a grove which does not constitute a flow path is formed in the surface of the container, and/or when the groove which does not constitute the flow path is provided in a boundary between the divided welding regions, surfaces to be used for welding and pressurization can overlap between the divided welding regions. Thus, design freedom for a welding machine can be increased.

When an over-sheet for covering the film is attached to the surface of the container, the film is protected by the over-sheet, thereby preventing leakage of ink, which would otherwise be caused by damage of the film, as well as evaporation of ink.

When the over-sheet has an extended region for covering a surface other than said surface of the container, and/or when the extended region covers an ink injection port, the area up to the ink injection port can be covered by one over-sheet. Thus, the ink cartridge of the invention is advantageous in simplifying manufacturing process and curtailing the number of components.

In case that the thickness of the film is set so as to become smaller than that of the over-sheet, the film is likely to follow the surface of the container when the ink flow recess and the atmosphere communication recess are sealed by welding the film. Hence, the ink cartridge of the invention is advantageous in improving welding strength and precision. Further, the film can be effectively protected by a comparatively-thick over-sheet.

In the invention, the term "welding region" means a region in which welding can be effected with use of a single welding and pressurizing surface.

The present disclosure relates to the subject matter contained in Japanese patent application Nos. 2001-148296 (filed on May 17, 2001), and 2001-149786 (filed on May 18, 2001), which are expressly incorporated herein by reference in their entireties.

DESCRIPTION OF THE PREFERRED EMBODIMENT

An embodiment of the invention will now be described in detail.

Figure 1:
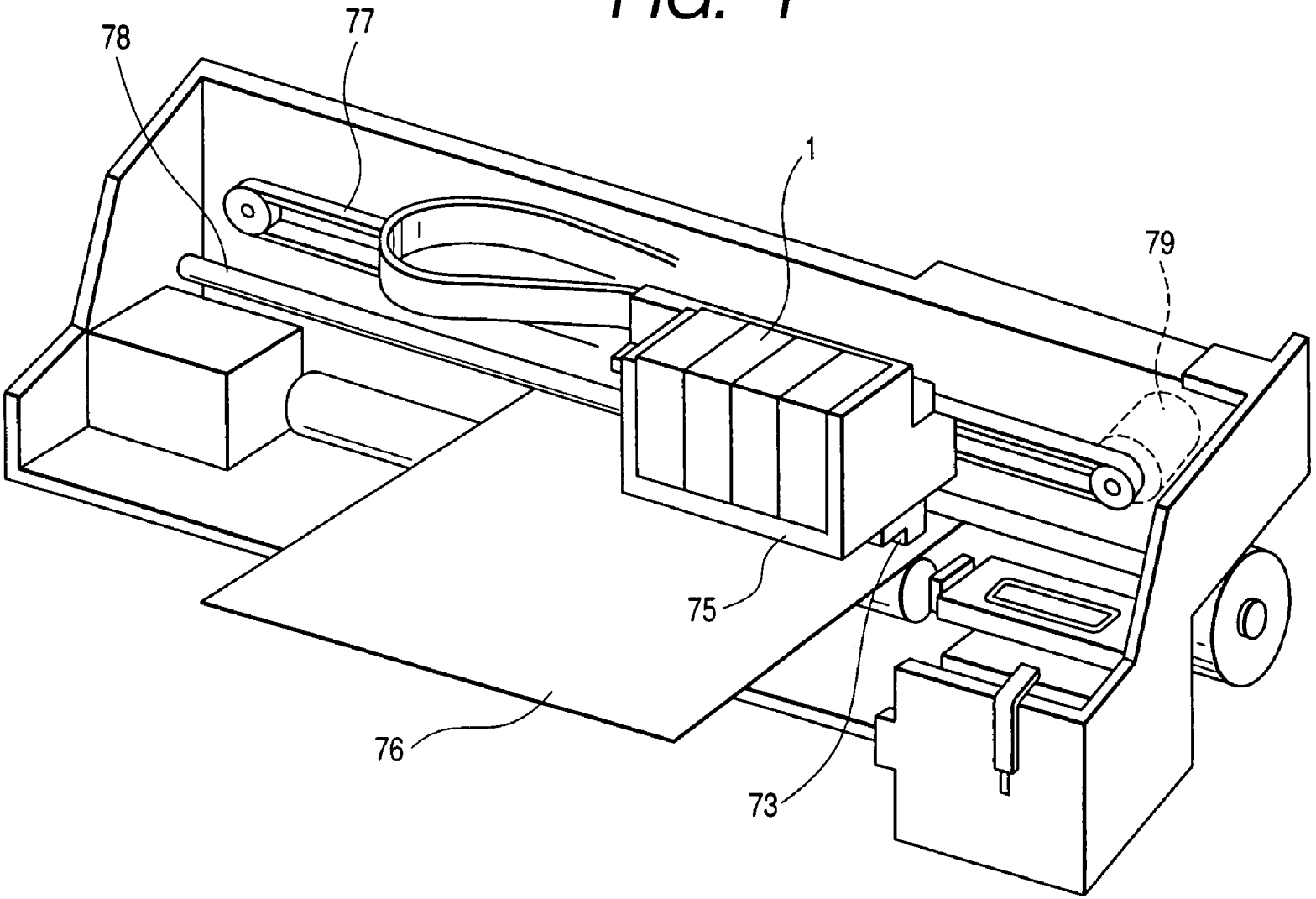
FIG. 1 is a perspective view showing an ink-jet recording apparatus using a cartridge according to the invention.

FIG. 1 is a view showing an example of an ink-jet recording apparatus employing an ink cartridge according to the invention. Ink cartridges to which the present invention is applied (hereinafter referred to simply as "cartridges") are mounted on a carriage 75 of the ink-jet recording apparatus. The carriage 75 has a recording head 73 attached thereto.

The carriage 75 is connected to a stepping motor 79 by way of a timing belt 77 and is guided by a guide bar 78, to travel back and forth across the width of recording paper (i.e., a primary scanning direction). The carriage 75 has substantially a box-like shape having an open top. The recording head 73 is mounted on the carriage 75 such that a nozzle surface of the recording head 73 is exposed at the surface of the carriage 75 opposing recording paper 76 (i.e., a lower surface of the carriage 75 in this example). The cartridges 1 are mounted on the carriage 75.

Ink is, supplied from the ink cartridges 1 to the recording head 73. Ink droplets are ejected onto an upper surface of the recording paper 76 while the carriage 75 is being moved, thereby printing an image or characters on the recording paper 76 in the form of a matrix of dots.

Figure 2:
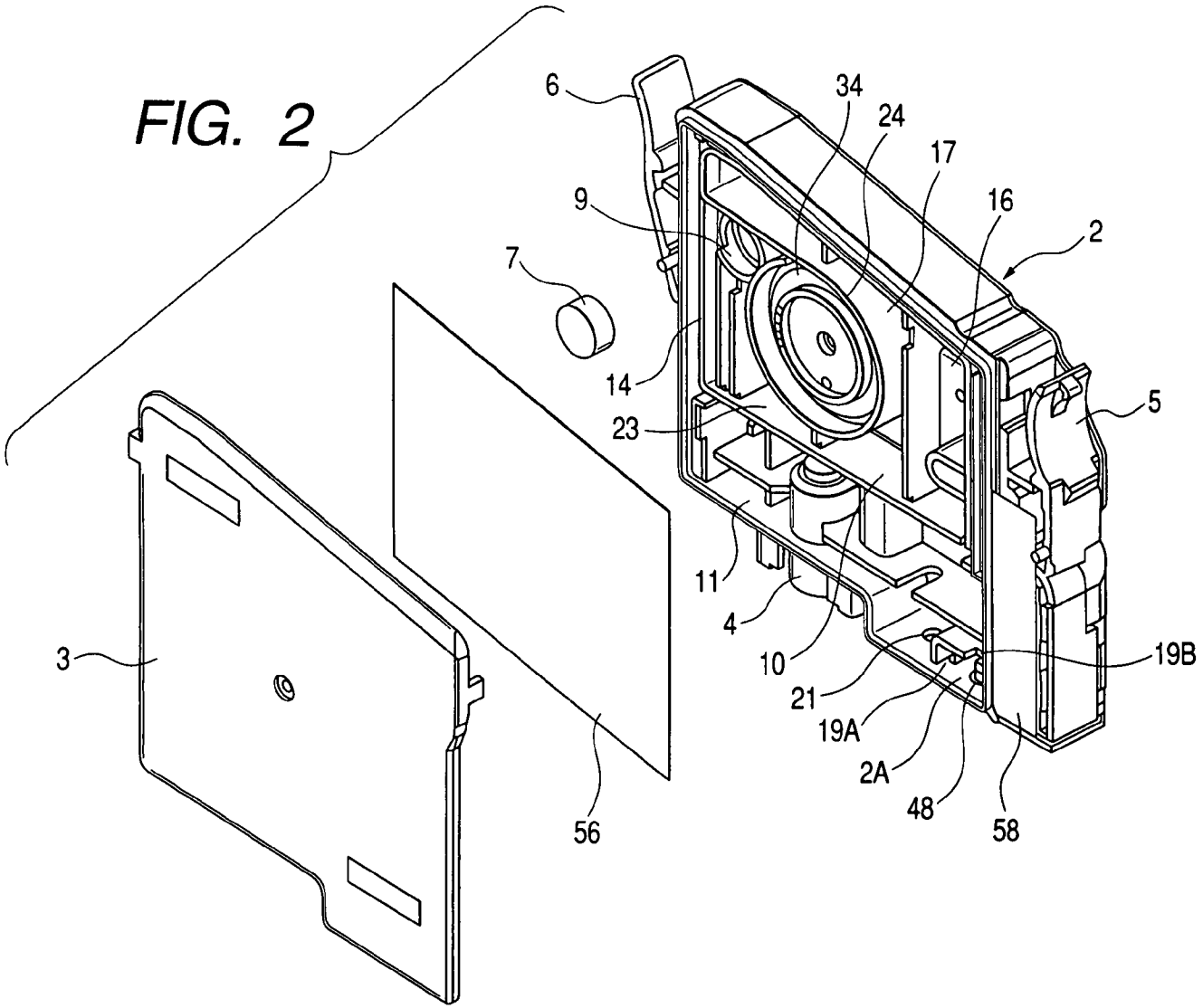
FIG. 2 is an exploded perspective view showing an embodiment of the cartridge of the invention.
Figure 3:
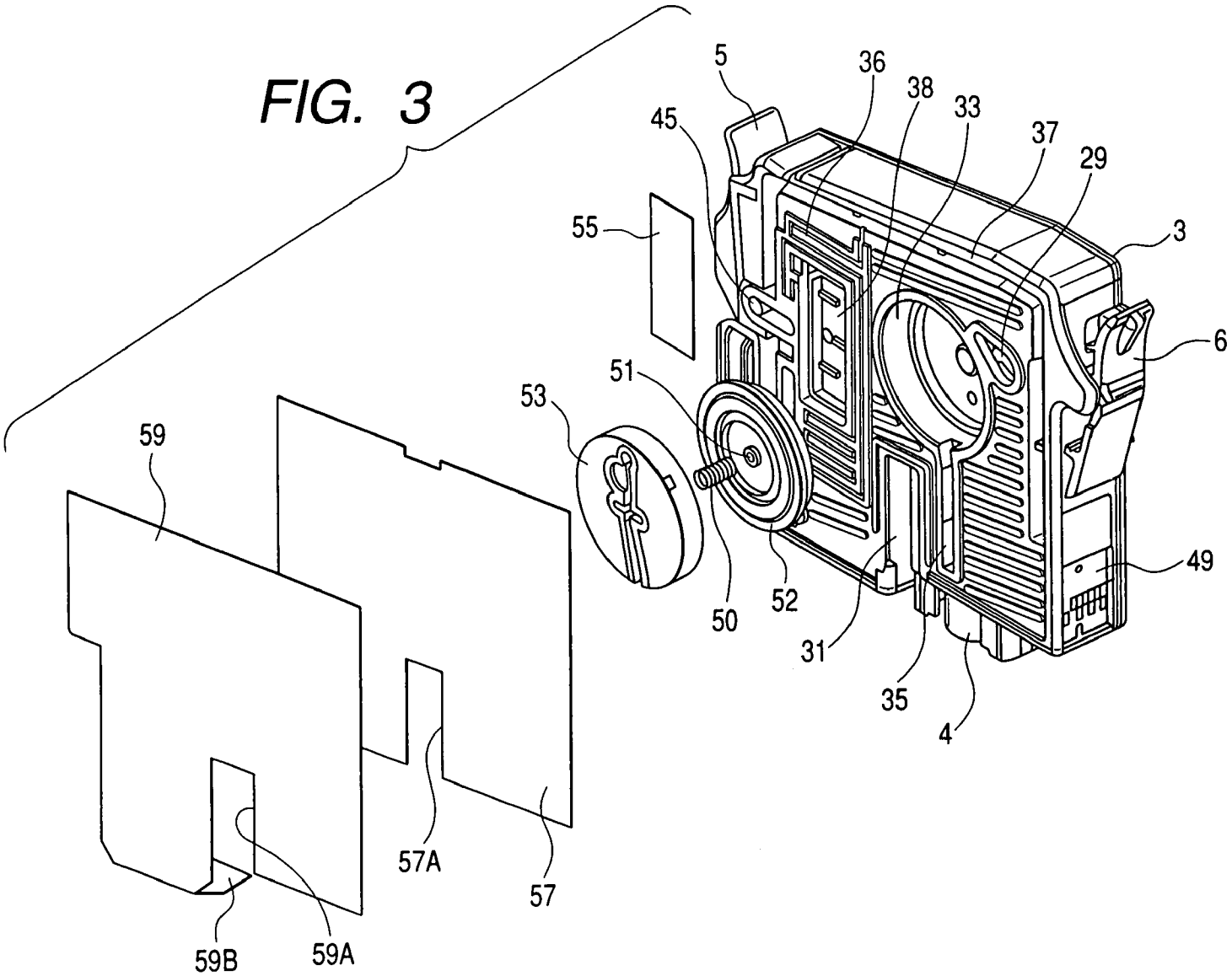
FIG. 3 is an exploded view showing the cartridge.
Figure 4:
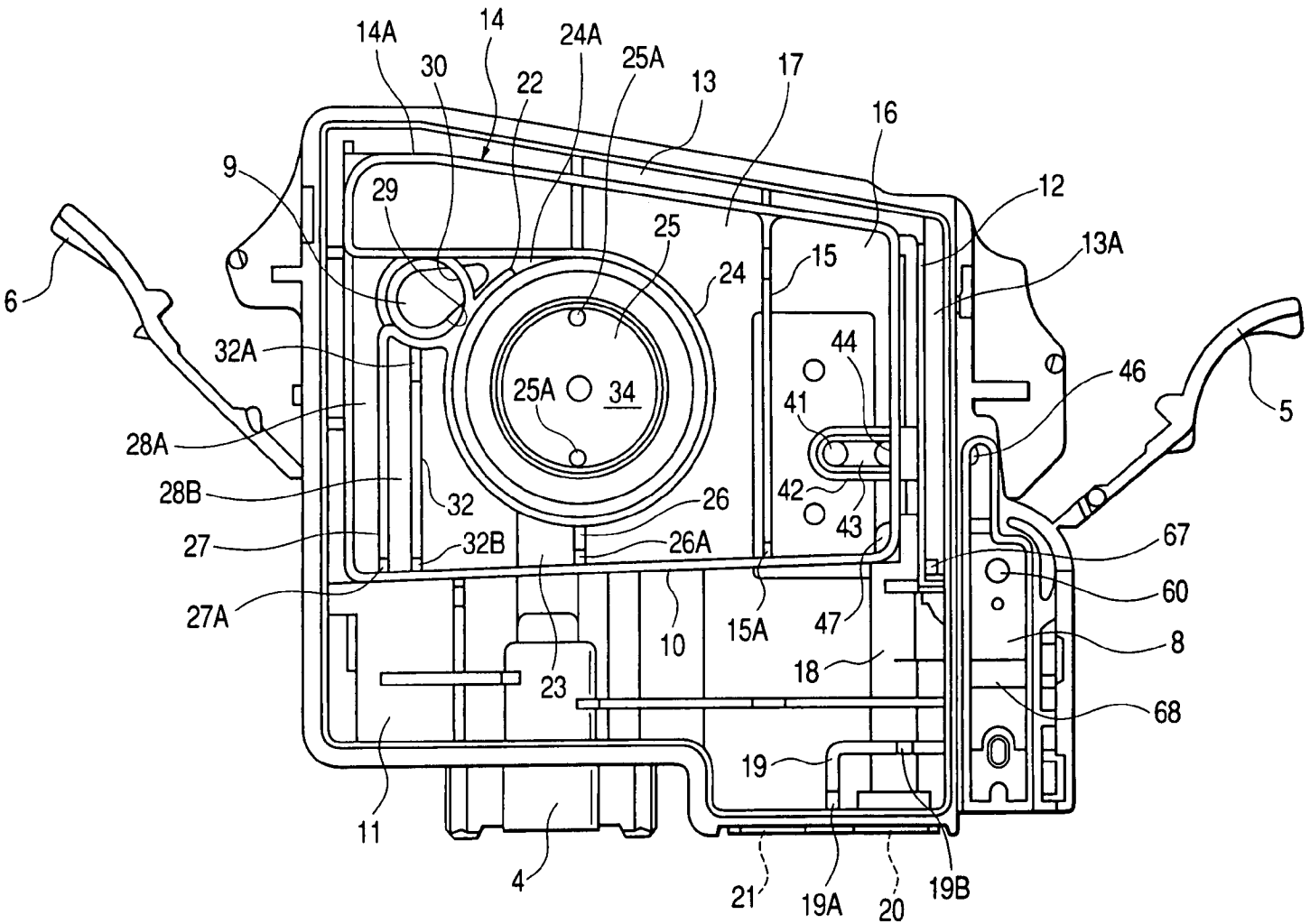
FIG. 4 is a view showing a configuration of an opening section of a container main body.
Figure 5:
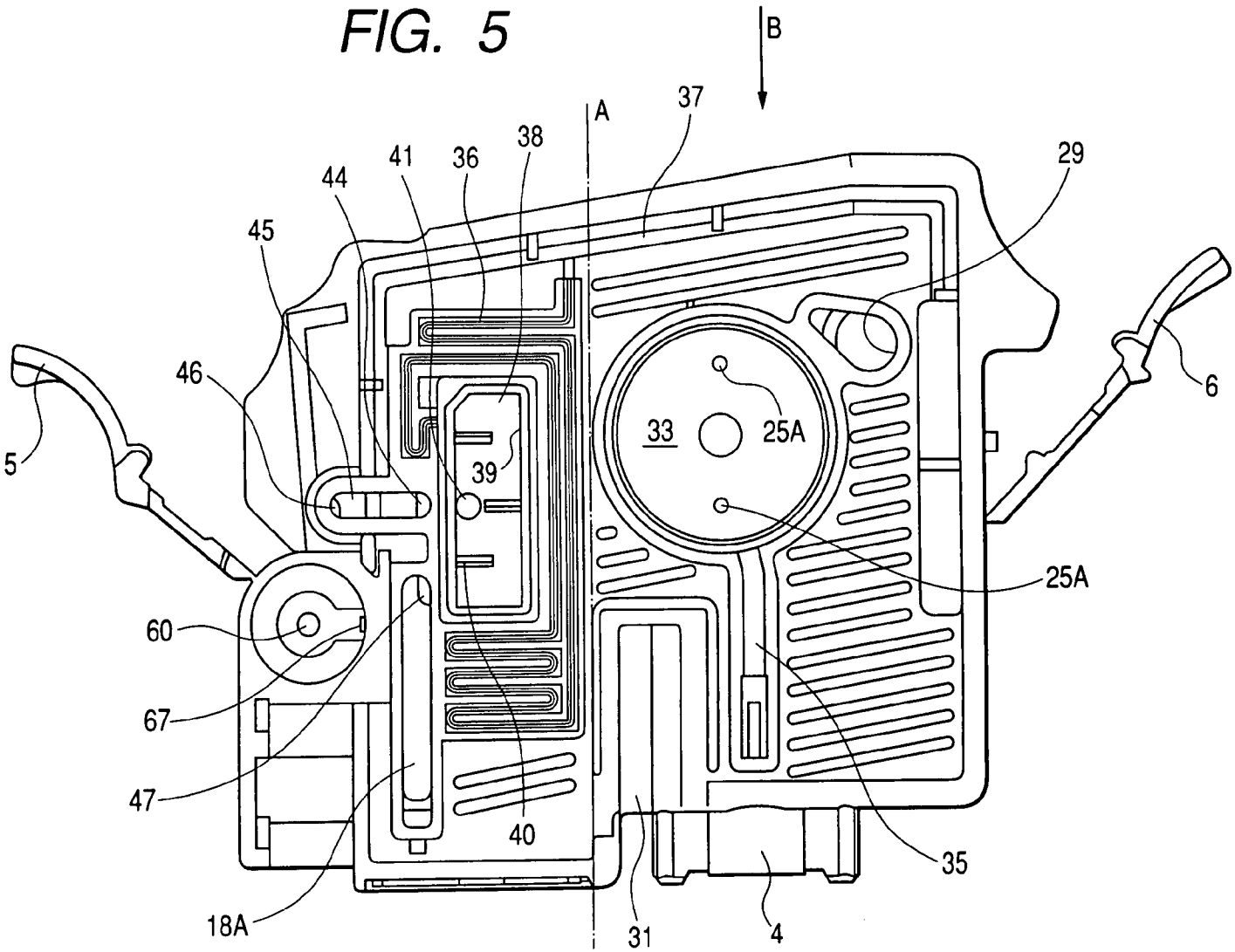
FIG. 5 is a view showing a configuration of a surface of the container main body.

FIGS. 2 and 3 are exploded perspective views showing an embodiment of the cartridge 1 of the invention. FIG. 4 is a view of a container main body 2 when viewed from an opening side thereof. FIG. 5 is a view of the container main body 2 when viewed from a front surface side thereof (the surface of the container main body 2 opposite the opening side thereof will be hereinafter called a "front surface of the container main body 2").

The cartridge 1 has a flat, rectangular, box-shaped container main body 2 which is open at one surface (i.e., a left side surface as viewed in FIG. 2); and a cover member 3 welded to the open surface to seal the opening. Both the container main body 2 and the closure 3 are made of synthetic resin.

Formed in the front surface of the container main body 2 are ink flow grooves 35, 18A which are to act as ink flow paths; and an atmosphere communication groove 36 which is to act as an atmosphere communication path. A single first film 57 possessing a gas impermeability is welded to the front surface of the container main body 2 so that openings of the ink flow grooves 35, 18A and atmosphere communication groove 36 are sealed, whereby the ink flow grooves 35, 18A constitute ink flow paths, and the atmosphere communication groove 36 constitutes an atmosphere communication path.

In this manner, the cartridge 1 of the invention is formed with the flow paths by sealing the opening of the ink flow groove 35 and that of the atmosphere communication groove 36 formed in the surface of the container main body 2 using the first film 57. Hence, a container having comparatively-complicated flow paths, such as an ink flow path and an atmosphere communication path, can be readily formed, thereby facilitating designing or processing of a molding die and enabling low-cost manufacture of an ink cartridge.

Structures of the flow paths in the container main body 2 will now be described in detail.

An ink supply port 4 is formed in the leading end surface of the container main body 2 in a direction in which the container main body 2 is to be inserted into the carriage 75 (i.e., in a bottom surface in the embodiment). Grip arms 5 and 6 to be gripped at the time of removal or attachment of the cartridge 1 are formed integrally with forward and backward surfaces (i.e., a right-side surface and a left-side surface in FIG. 4) of the container main body 2. A valve member (not shown) to be opened by insertion of an ink supply needle is housed in the ink supply port 4. In FIG. 3, reference numeral 49 designates a memory device provided in a portion of the container main body 2 close to the ink supply port 4 and below the grip arm 6.

Formed in the opening side interior of the container main body 2 is a frame section 14 including a wall 10 which extends in a substantially horizontal direction and is sloped slightly downward toward the ink supply port 4. The frame section 14 is spaced at a substantially uniform clearance from a ceiling surface and both side surfaces of the container main body 2. An area located beneath the frame section 14 forms a first ink chamber 11 for storing ink.

The clearance formed between the frame section 14, and the outer-peripheral wall of the container main body 2 and a wall 12 provided along the side of the frame section 14 opposing a valve storage chamber 8 constitute atmosphere communication paths 13, 13A which bring the first ink chamber 11 in communication with the atmosphere by way of a through hole 67.

The cover 3 is attached to the wall 12 and the outer peripheral wall of the container main body 2 by means of fusing, thus constituting the atmosphere communication path 13A. The upper end of the wall 12 constituting the atmosphere communication path 13A extends up to the neighborhood of the ceiling of the container main body 2 so as to protrude upward from a fluid level of the ink stored in the first ink chamber 11 when the ink cartridge is in use. As a result, an opening of the atmosphere communication path 13A is opened at a location upward from the fluid level of the ink stored in the first ink chamber 11, thereby preventing, to the extent possible, reverse flow of ink into the through hole 67.

The inside of the frame section 14 is divided into left and right sub-divisions by a wall 15. A communication port 15A through which ink flows is formed in a bottom of the wall 15, and the wall 15 extends in a vertical direction. The sub-division that is divided by the wall 15 and is located on the right side of the drawing forms a second ink chamber 16 for temporarily storing the ink sucked up from the first ink chamber 11. Formed in the sub-division located,on the left side of the drawing are a third ink chamber 17, a fourth ink chamber 23, and a fifth ink chamber 34. Further, a differential pressure regulating valve constituted of a membrane valve 52, a spring 50, etc. is also housed in the left-side sub-division.

Formed in the area of the first ink chamber 11 located below the second ink chamber 16 is a suction flow path 18 which connects the second ink chamber 16 to surroundings of a bottom surface 2A of the container main body 2 to suck-up ink in the first ink chamber 11 into the second ink chamber 16. A rectangular region surrounded by a wall 19 is formed in an area located below the suction flow path 18. A communication port 19A is formed in a lower portion of the wall 19, and another communication port 19B is formed in an upper surface of the wall 19.

The suction flow path 18 is defined by forming a channel-like ink flow groove 18A in the front surface of the container main body 2, and sealing the ink flow groove 18A with the first film 57.

An upper portion of the suction flow path 18 is in communication with the second ink chamber 16 by way of a communication port 47. An opening section 48 is formed in a lower portion of the suction flow path 18 located within the rectangular region surrounded by the wall 19. An opening 18B (see FIG. 9B) formed in the lower end of the suction flow path 18 is in communication with the first ink chamber 11. As a result, the first ink chamber 11 and the second ink chamber 16 are in communication with each other by way of the suction flow path 18, and the ink stored in the first ink chamber 11 is introduced into the second ink chamber 16.

An ink injection port 20 to be used in injecting ink into the first ink chamber 11 is formed in an area on the bottom surface of the container main body 2 corresponding to the suction flow path 18. An air vent 21 which allows air to escape at the time of injection of ink is formed in the vicinity of the ink injection port 20.

A wall 22 is formed in the third ink chamber 17 so as to extend horizontally while being spaced a given interval from an upper surface 14A of the frame section 14. The third ink chamber 17 is partitioned by a substantially-arc-shaped wall 24 continuous with the wall 22. A differential pressure regulating valve storage chamber 33 and the fifth ink chamber 34 are formed in the area surrounded by the wall 24.

The area surrounded by the arc-shaped wall 24 is divided into two sub-divisions in the thickness direction, by a wall 25, such that a differential pressure regulating valve storage chamber 33 is formed in the area on the front surface side and opposite from the fifth ink chamber 34. The wall 25 has ink-flow-path ports 25A for guiding the ink having flowed into the fifth ink chamber 34 to the differential pressure regulating valve storage chamber 33.

A partition wall 26 having a communication port 26*a* is provided between a lower portion of the wall 24 and the wall 10. The area located downstream of the partition wall 26 (a left-side in FIG. 4) is formed as the fourth ink chamber 23. Interposed between the substantially arc-shaped wall 24 and the frame section 14 are a partition wall 27 and a partition wall 32. A communication port 27A is formed in a lower portion of the partition wall 27, and the partition wall 27 extends vertically. Further, a communication ports 32A and 32B are respectively formed in upper and lower portions of the vertically extending partition wall 32.

An arc-shaped wall 30 is formed in the container main body 2 so as to be continuous with an upper end section of the partition wall 27, and is connected to the substantially-arc-shaped wall 24 and the wall 22. An area surrounding by the substantially arc-shaped wall 30 is formed into a filter housing chamber 9 for housing a block-shaped filter (a cylindrical filter in the embodiment) therein.

A through hole 29 having a combined shape of a large circle portion and a small circle portion is formed so as to extend across the circular-arc-shaped wall 30 constituting the filter housing chamber 9. The large circle portion of the through hole 29 is in communication with the upper portion of the ink flow path 28A, and the small circle portion of the through hole 29 is in communication with an upper portion of the fifth ink chamber 34 by way of a communication port 24A formed in a tip end portion of the substantially-arc-shaped wall 24. As a result, the ink flow path 28A and the fifth ink chamber 34 are in communication with each other by way of the through hole 29.

The ink that has flowed from the second ink chamber 16 into the ink flow path 28A by way of the communication ports 15A, 26A, 32B, 27A, etc. flows into the large circle portion of the through hole 29 after having been filtered by the filter 7 of the filter housing chamber 9. The ink that has flowed into the through hole 29 flows from the small circle portion of the through hole 29 into the fifth ink chamber 34 by way of the communication port 24A. An opening of the through hole 29 formed in the front surface side of the container main body 2 is also sealed by the first film 57.

A gas impermeable second film 56 is attached to the opening side of the frame section 14 by means of welding. That is, the second film 56 is attached to the frame section 14, the walls 10, 15, 22, 24, 30, and 42, and the partition walls 26, 27, and 32 by means of welding, thus constituting ink chambers and flow paths.

A lower portion of the differential pressure regulation valve storage chamber 33 and the ink supply port 4 are in communication with each other via the flow path defined by the ink flow groove 35 formed in the front surface of the container main body 2 and the gas impermeable first film 57 covering the ink flow groove 35. The upper and lower ends of the ink flow groove 35 are respectively in communication with the differential pressure regulation valve storage chamber 33, and the ink supply port 4. As a result, the ink that has flowed into the fifth ink chamber 34 passes through the ink-flow-path ports 25A and the differential pressure regulating valve storage chamber 33, and flows into the ink supply port 4 by way of the flow path defined by the ink groove 35.

Formed in the front surface of the container main body 2 are the atmosphere communication groove 36 which meanders so as to increase flow resistance to the greatest possible extent; and a wide groove 37 which is in communication with the atmosphere communication groove 36 and surrounds the differential pressure regulating valve storage chamber 33 and the atmosphere communication groove 36. Further, a rectangular recess 38 is formed in an area in the front surface of the container main body 2 and corresponding to the second ink chamber 16.

A frame section 39 and ribs 40 are formed with in the rectangular recess 38 at a location lowered from an open edge of the recess 38. A gas permeable sheet 55 possessing an ink repellent characteristic is stretched over and attached onto the frame section 39 and the ribs 40. As a result, the inside of the rectangular recess 38 is formed into an atmosphere communication chamber which is in communication with the atmosphere by way of the atmosphere communication groove 36 and the groove 37.

A through hole 41 is formed in a deep surface of the recess 38, and is in communication with a narrow, elongated area 43 defined by an elongated oval wall 42 provided within the second ink chamber 16. The area of the recess 38 closer to the front surface side than the gas permeable sheet 55 is located is in communication with the atmosphere communication groove 36. Further, a through hole 44 is formed in the end of the narrow, elongated area 43 opposite from the through hole 41. The through hole 44 is in communication with the valve storage chamber 8 serving as an atmosphere release valve chamber, by way of a communicating groove 45 formed in the front surface side of the container main body 2 and a through hole 46 formed in communication with the groove 45.

A through hole 60 is formed in the valve storage chamber 8 so as to be in communication with the through hole 67 formed in the atmosphere communication path 13A formed in the first ink chamber 11. As a result, the air that has entered the recess 38 by way of the atmosphere communication groove 36 reaches the valve storage chamber 8, by way of the through hole 41, the narrow, elongated area 43, and the through holes 44, 46. The air further reaches the first ink chamber 11 from the valve storage chamber 8, by way of the through hole 60, the communication hole 67, and the atmosphere communication paths 13, 13A.

The cartridge insertion side of the valve storage chamber 8 (i.e., a bottom surface in the embodiment) is opened. As will be described later, identification pieces and an operation lever provided on a recording apparatus main unit can enter into the storage chamber 8 through the opening. Housed in an upper portion of the valve storage chamber 8 is an atmosphere release valve which opens upon entry of the operation lever, thereby maintaining a normally-open valve status.

Figure 6:
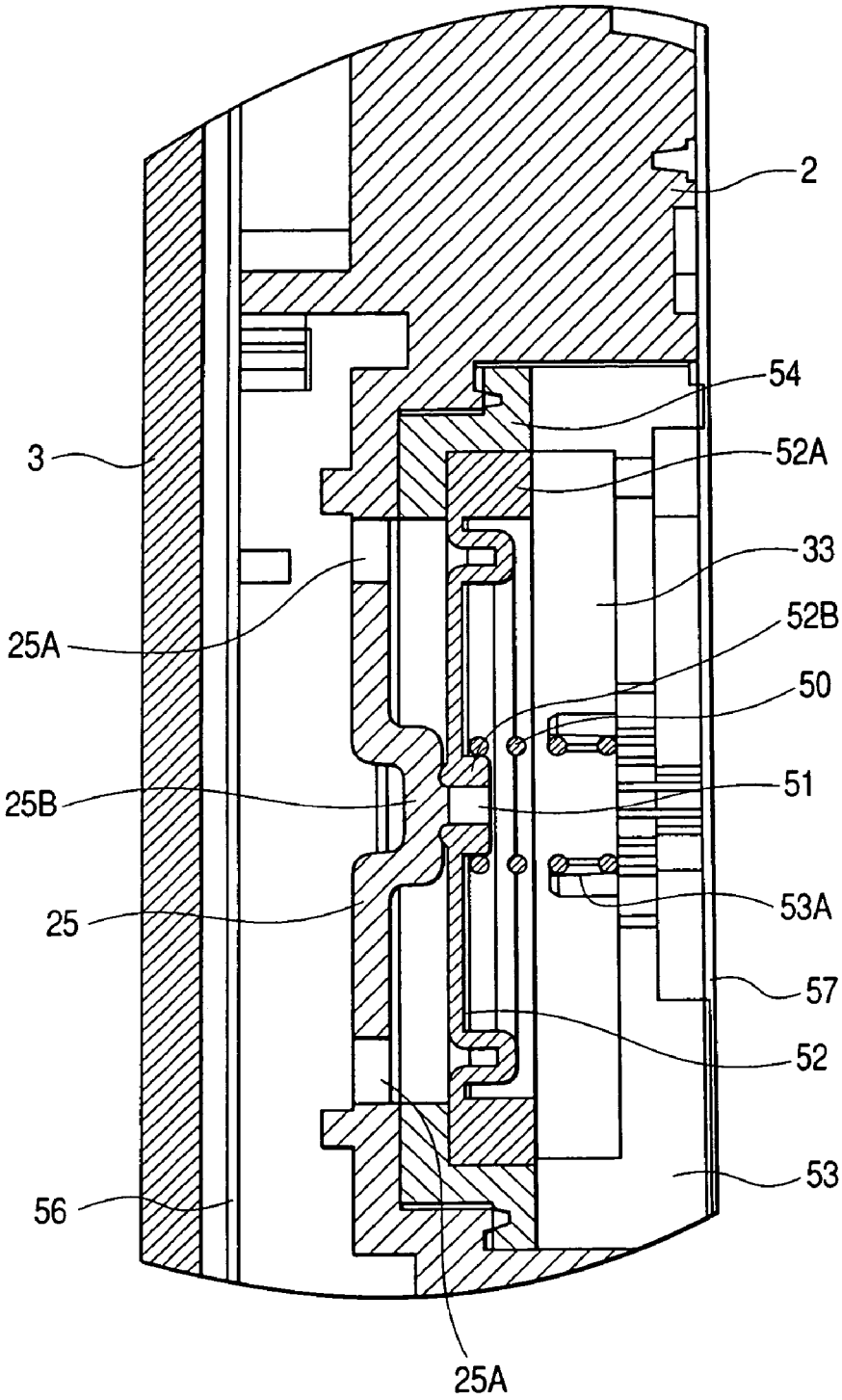
FIG. 6 is an enlarged view showing a cross-sectional structure of a differential pressure regulating valve storage chamber.

FIG. 6 shows a cross-sectional view of the structure located in the vicinity of the fifth ink chamber 34 and the differential pressure regulating valve storage chamber 33. The right-side portion of the drawing shows the front surface side of the container main body 2 where the differential pressure regulating valve storage chamber 33 is located. Stored in the differential pressure regulating valve storage chamber 33 are the spring 50 and the membrane valve 52 formed of an elastically-deformable material, such as elastomer. The membrane valve 52 has a through hole 51 formed in the center thereof. The membrane valve 52 has an annular thick-walled section 52A in the periphery thereof, and is fastened to the container main body 2 by way of a frame section 54 formed integrally with the thick-walled section 52A. One end of the spring 50 is contacted with and supported by a spring receiving section 52B of the membrane valve 52, and the other end of the same is contacted with and supported by a spring receiving section 53A of a lid member 53 which closes the differential pressure regulating valve storage chamber 33.

With this arrangement, the membrane 52 blocks flow of the ink that has flowed from the fifth ink chamber 34 and passed through the ink-flow-path ports 25A. If the pressure of the ink-supply port 4 has dropped in this state, the membrane valve 52 is separated from a valve seat section 25B against the urging force of the spring 50, by the negative pressure. Hence, the ink passes through the through hole 51 and flows into the ink supply port 4 via the flow path defined by the ink flow groove 35.

When an ink pressure of the ink supply port 4 has risen to a predetermined level, the membrane valve 52 is brought, by the urging force of the spring 50, into elastic contact with the valve seat section 25B, thus interrupting the ink flow. Through repetition of this operation, ink can be output to the ink supply port 4 while a constant negative pressure is maintained.

Figure 7:
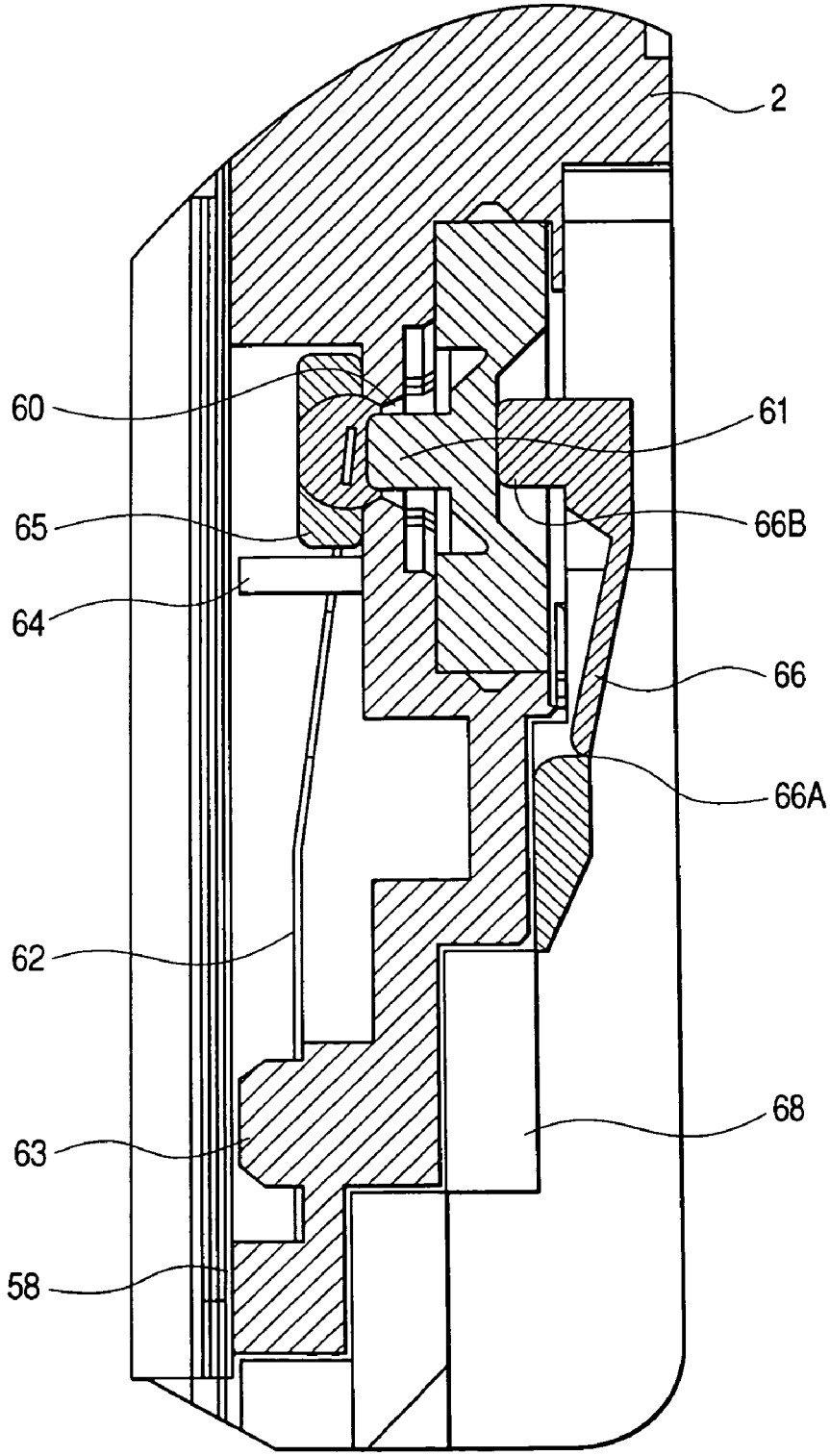
FIG. 7 is an enlarged view showing a cross-sectional structure of a valve storage chamber.

FIG. 7 shows a cross-sectional view of the structure of the valve storage chamber 8 for use in communication with the atmosphere. The right-side portion of the drawing shows the front surface side of the container main body 2. A through hole 60 is formed in the partition wall defining the valve storage chamber 8. A press member 61 constituted of an elastic member, such as rubber, is fitted into the through hole 60 in a movable manner while surroundings of the press member 61 are supported by the container main body 2. A valve member 65 is disposed on the leading end of the press member 61 in the entry side so that the valve member 65 is supported by an elastic member 62, and constantly urged onto the through hole 60. In this example, a plate spring is used as the elastic member 62, such that the lower end of the spring is fixed by a projection 63 and the central portion of the spring is regulated by projections 64.

An arm 66 is disposed on the other side of the press member 61. The cartridge insertion direction side of the arm 66 (i.e., a lower end in the embodiment) is fixed to the container main body 2 by way of a pivot point 66A located at an inner side than an operation lever 70 to be described later. The pulling-out side of the arm 66 (i.e., an upper side in the embodiment) obliquely projects into an entry path of the operation lever 70. A protuberance 66B is formed at the leading end of the arm 66 for resiliently pressing the press member 61. With this construction, at the time when the valve member 65 is opened, the through hole 67 formed in an upper portion of the first ink chamber 11 is connected to the atmosphere communicating recess 38 by way of the through hole 60, the valve storage 8, the through hole 46, the groove 45, the through hole 44, the narrow, elongated region 43 and the through hole 41.

Figure 8:
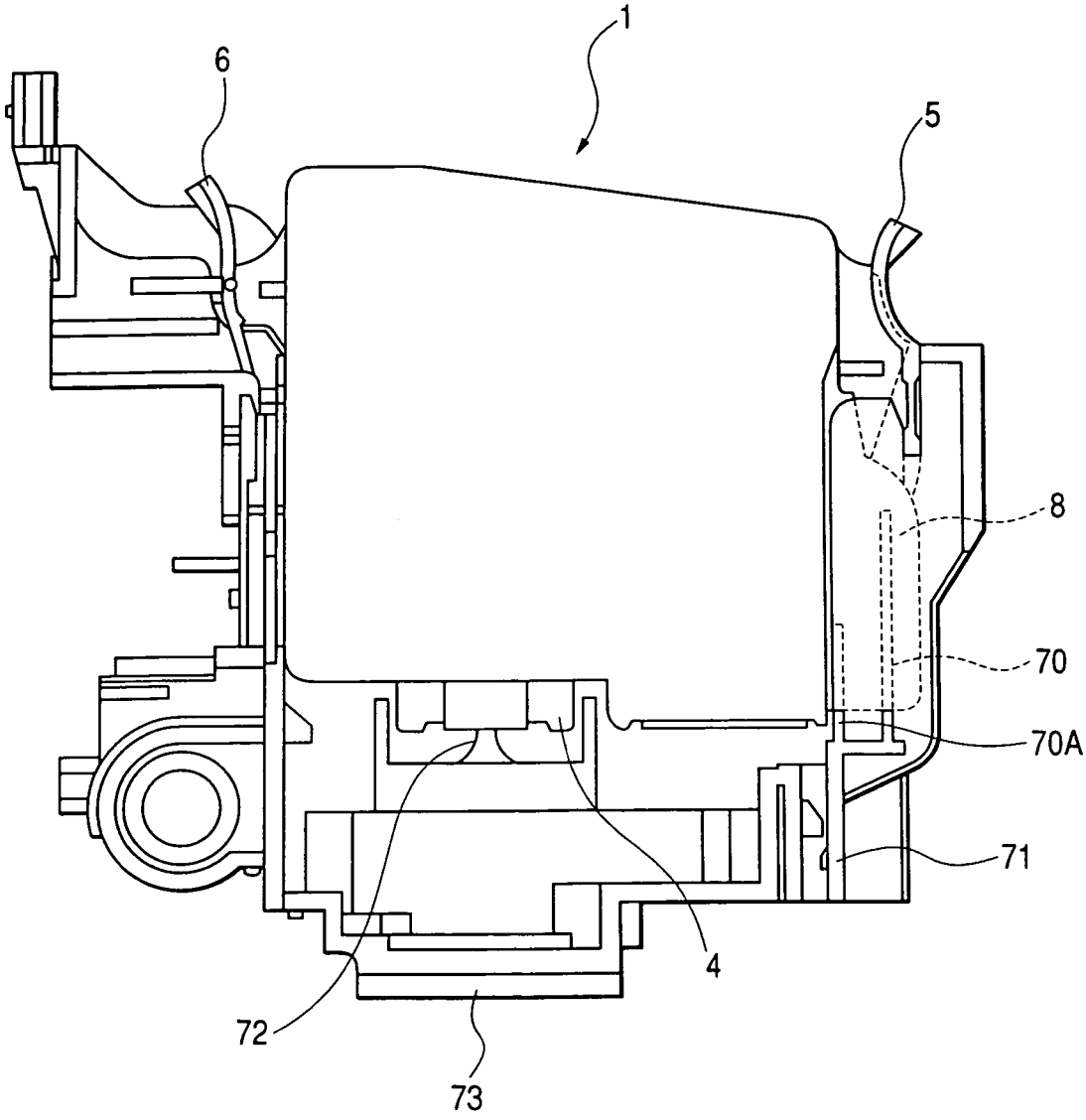
FIG. 8 is a view showing an example cartridge holder.

A identification projection 68 is provided in the valve storage chamber 8 at a location closer to the insertion direction side (i.e., the lower side in the embodiment) than the arm 66 is located, for identifying whether or not the cartridges 1 are suitable for the recording apparatus. The identification projection 68 is disposed at such a location that a determination can be made through use of the identification piece (operating rod) 70 before the ink supply port 4 is connected to the ink supply needle 72 (see. FIG. 8) and the valve member 65 is opened.

With this arrangement, when the cartridge 1 is loaded into a cartridge holder 71 having the operation rod 70 provided upward on a lower surface thereof, as shown in FIG. 8, the operating rod 70 is brought into contact with the inclined arm 66 to tilt the press member 61 toward the valve member 65 in association with pressing of the cartridge 1. As a result, the valve member 65 is separated from the through hole 60, and the atmosphere communication recess 38 is opened to the atmosphere by way of the through hole 46, the groove 45, the through hole 44, the area 43, and the through hole 41 as described above.

When the ink cartridge 1 is pulled out from the cartridge holder 71, the arm 66 becomes free from the support by the operation rod 70. As a result, the valve member 65 closes the through hole 60 under the urging force of the elastic member 62, thereby interrupting communication between the ink storage region and the atmosphere.

Next, the gas impermeable first film 57 is attached to the front surface of the container main body 2 so as to cover at least the area having the recess formed therein, after all the components, such as valves, are incorporated into the container main body 2. As a result, a capillary serving as an atmosphere communication path is formed in the front surface side of the container main body 2 by the recess and the first film 57.

Here, the detailed description will be given of the layout and formation of the flow paths, including the capillary.

In case of the ink cartridge 1 as mentioned above, the single first film 57 is welded to the front surface of the container main body 2 of the cartridge 1 to seal the openings of the ink flow groove 35, the through hole 29, the ink flow groove 18A, the groove 45, the atmosphere communication groove 36, and the recess 38 in the front surface of the container main body 2, whereby the ink flow groove 35, the through hole 29, the ink flow groove 18A, and the groove 45 define respective ink flow paths, and the atmosphere communication groove 36 and the recess 38 define respective atmosphere communication paths. FIG. 9 shows a state of the cartridge 1 where the first film 57 has been welded thereto.

At this time, the first time 57 is welded to the front surface of the container main body 2, by such a thermal welding method that the first film 57 is applied to cover the front surface of the container main body 2, and pressed using a heating/pressurizing plate.

Here, the atmosphere communication groove 36 is formed as a shallow, narrow, complicatedly-bent groove in order to prevent evaporation of ink to the extent possible and to avoid an unduly increased flow resistance. Therefore, when the atmosphere communication groove 36 is sealed by the first film 57, the atmosphere communication groove 36 may be collapsed or destroyed to hinder an air communication unless the height at which the first film 57 is to be welded is controlled with high precision. On the other hand, it is preferably that the welding, the importance of which is given to welding strength is carried out for the recess constituting an ink flow path, such as the ink groove 35, in order to prevent leakage of ink.

Figure 10:
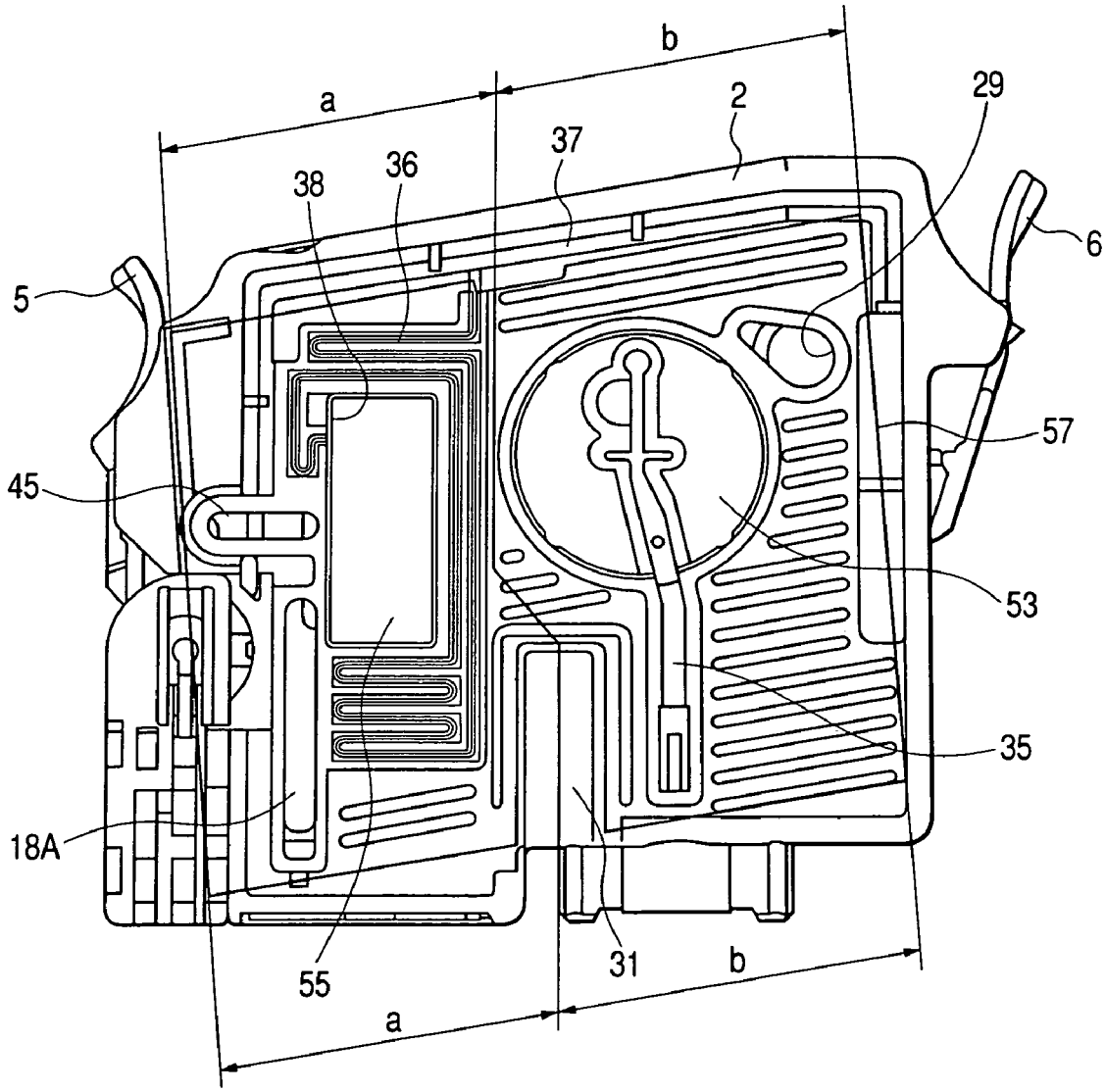
FIG. 10 is a descriptive view showing the layout of flow paths of a cartridge according to the invention.

For this reason, as shown in FIG. 10, the layout of flow paths in the front surface of the container main body 2 is such that the front surface can be roughly divided into a region (b) where recesses, such as the ink flow groove 35 and the through hole 29, defining the ink flow paths are primarily disposed, and a region (a) where the atmosphere communication groove 36 is primarily disposed. Further, a groove 31 that does not form a flow path is disposed in a boundary between regions (a) and (b) in the front surface of the container main body 2.

Moreover, a range where the first film 57 is pressurized at one time using one heating/pressurizing plate when the first film 57 is welded to the container main body 2 (hereinafter called a "welding region") is set as each of divided regions (a) and (b) where the region (a) primarily requires management of precision for welding height, and the region (b) primarily requires management of welding strength. Welding requirements or conditions are controlled independently in the respective regions (a) and (b). As a result, welding precision and welding strength can be managed concurrently. Further, since the control of a welding status for a relatively small area is made possible, setup of welding requirements can be performed comparatively readily.

In other words, the region of the first film 57 to be welded is divided into the region (b), where the ink flow groove 35 is formed, which defines the ink flow path located downstream of the differential pressure valve generating negative pressure within the cartridge 1, and the other region (a). That is, in case of the cartridge having the differential pressure regulating valve, the geometries of flow paths, such as the ink flow paths and atmosphere communication paths, become comparatively complicated, and therefore a noticeable effect can be obtained to readily form the complicated flow paths.

Figure 9A:
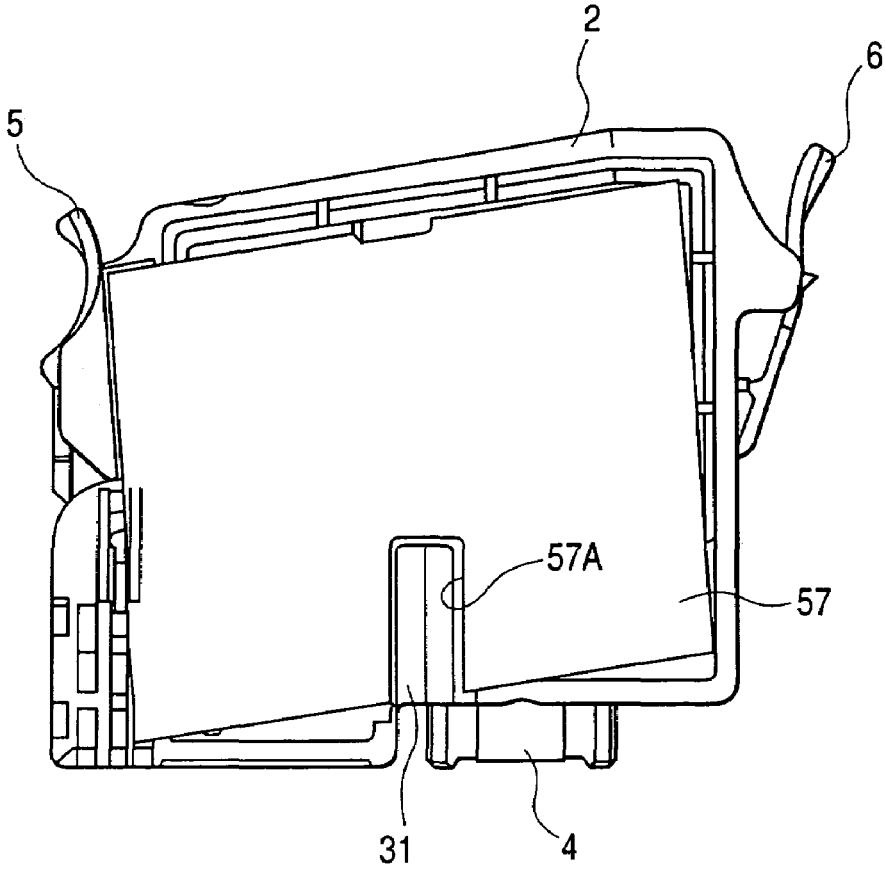
FIG. 9 is a view showing a welded status of a first film.
Figure 9B:
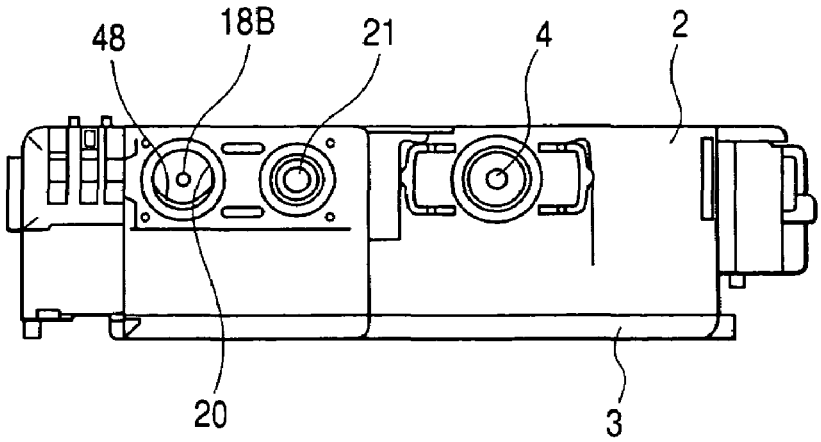

Since the groove 31 which does not constitute any flow path is situated in a boundary between the divided welding regions (a),(b), surfaces to be used for welding and pressurizing the first film 57 can overlap between the divided welding regions (a), (b), thereby increasing a design freedom of a welding machine. In FIGS. 9A and 9B, reference numeral 57A designates a notch provided in the area of the first film 57 corresponding to the groove 31.

Figure 11A:
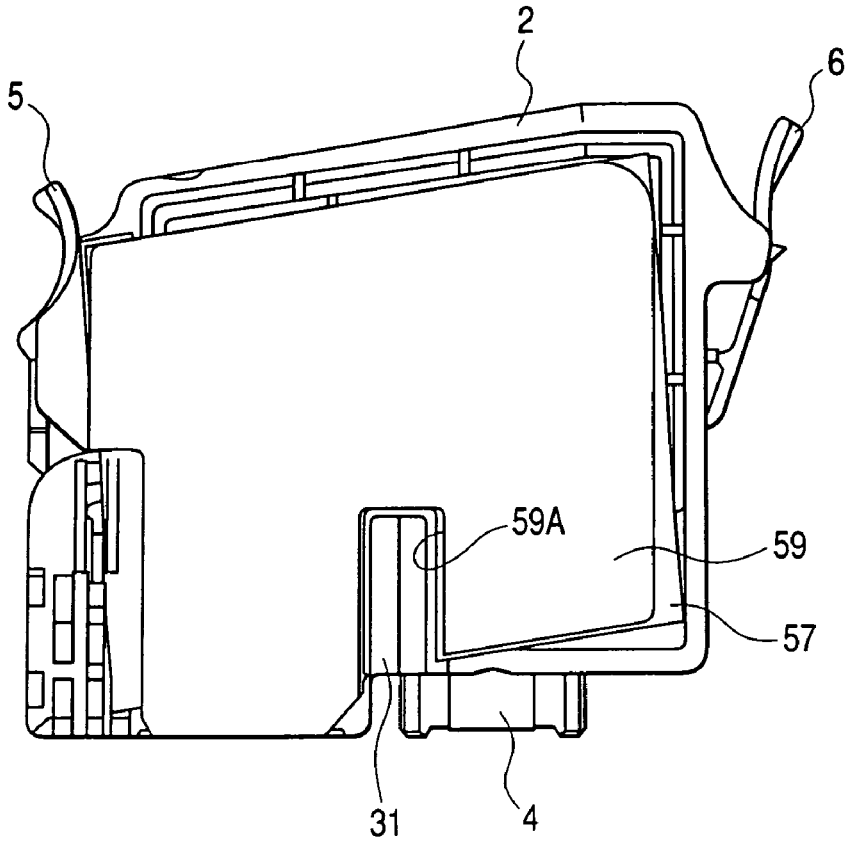
FIG. 11 is a view showing a welded status of an over-sheet.
Figure 11B:
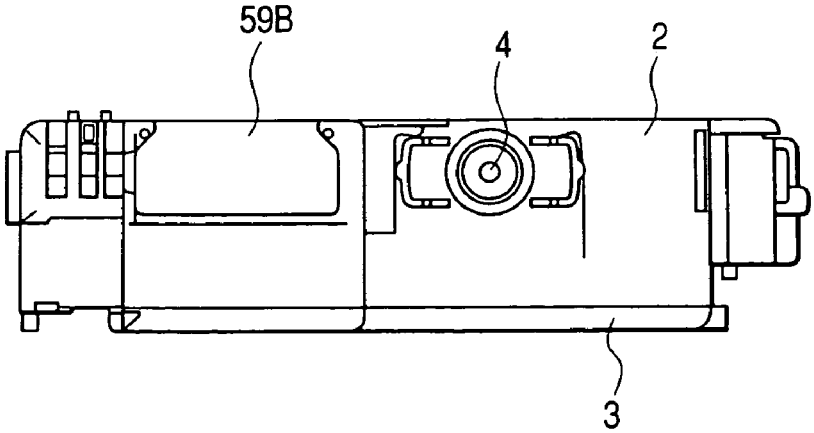

As shown in FIG. 11, in the case of the cartridge 1 mentioned above, an over-sheet 59 for covering the first film 57 is attached to the front surface side of the container main body 2. With this arrangement, the over-sheet 59 protects the first film 57, thereby preventing leakage of ink caused by damage of the first film 57, and eliminating evaporation of ink. In the drawing, reference numeral 59A designates a notch formed in the area of the over-sheet 59 corresponding to the groove 31.

A sheet which is thicker than the first film 57 is used as the over-sheet 59. That is, in the case of the cartridge 1 mentioned above, the thickness of the first film 57 is set smaller than that of the over-sheet 59. As a result, when the ink grooves 35, 18A, the atmosphere communication groove 36, etc. are sealed by welding the first film 57, the first film 57 is readily overlaid along the front surface of the container main body 2, and hence it is advantageous in improving welding strength and precision. The first film 57 can be effectively protected by the relatively thick over-sheet 59.

The over-sheet 59 is formed with an extended area 59B for covering a portion of the lower surface of the container main body 2, and the extended area 59B covers the ink injection port 20 and the air outlet port 21. Thus, the single over-sheet 59 can cover up to the ink injection port 20 and the air outlet port 21, and hence it is advantageous in simplifying manufacturing processes and reducing the number of components.

As mentioned-above, the gas impermeable second film 56 is thermally-welded to the opening section of the container main body 2 to be hermetic with respect to the frame section 14, the walls 10, 15, 22, 24, 30, and 42, and the partition walls 26, 27, and 32. The cover 3 is further placed over the second film 56 and fixed by welding. As a result, the areas partitioned by the walls are sealed so as to be in communication by way of only communication ports or openings.

Similarly, an opening of the valve storage chamber 8 is sealed with the gas impermeable third film 58 by thermal welding, thus completing the cartridge 1. By adopting such a structure that the ink storage area is sealed using the gas impermeable first and second films 56, 57, etc., the container main body 2 can be formed readily, and also ink pressure can be maintained as constant as possible because fluctuations in ink stemming from reciprocal movement of the carriage can be absorbed by deformation of the first and second films 56, 57.

Next, an ink injection tube is inserted into the ink injection port 20, and sufficiently degassed ink is injected while the air outlet port 21 is remained open. After completion of injection of ink, the ink injection port 20 and the air outlet port 21 are sealed with a film and the over-sheet 59.

Since the ink cartridge 1 having such a construction is preserved while being isolated from the atmosphere by the valves, etc., the degassed rate of ink is sufficiently maintained.

In a case where the cartridge 1 is loaded into the cartridge holder 71, if the cartridge 1 is suitable for the cartridge holder 71, the ink supply port 4 enters up to a position where the ink supply needle 72 is inserted into the ink supply port 4. As mentioned previously, the through hole 60 is released by the operation rod 70, whereby the ink storage region is brought in communication with the atmosphere, and the valve of the ink supply port 4 is opened by the ink supply needle. 72.

If the cartridge 1 is not suitable for the cartridge holder 71, the identification protuberance 68 comes into contact with an identification piece 70A of the holder 71 before the ink supply port 4 reaches the ink supply needle 72, thus hindering advancement of the ink supply port 4. In this state, the operation rod 70 is also unable to reach the arm 66. Hence, the valve member 65 maintains a sealed status, and release of the ink storage region to the atmosphere is hindered, thereby preventing evaporation of ink.

When the cartridge 1 has been properly loaded into the cartridge holder 71 and ink has been consumed by the recording head 73 as a result of execution of printing operation, the pressure of the ink supply port 4 drops to a specified level or less, and the membrane valve 52 is opened. Further, if the pressure of the ink supply port 4 has increased, the membrane valve 52 is closed. Thus, the ink maintained at predetermined negative pressure flows into the recording head 73.

When consumption of ink by the recording head 73 has proceeded, the ink stored in the first ink chamber 11 flows into the second ink chamber 16 by way of the suction flow path 18. Air bubbles having flowed into the second ink chamber 16 are elevated by means of buoyancy, and only ink flows into the third ink chamber 17 by way of the communication port 15A located in the low part of the second ink chamber 16.

The ink stored in the third ink chamber 17 flows into the ink flow paths 28A, 28B by way of the fourth ink chamber 23 after having passed through the communication port 26A of the partition wall 26 formed in the lower end of the substantially-circular wall 24.

The ink having flowed through the ink flow path 28A flows into the filter storage chamber 9, where the ink is filtrated by the filter 7. The ink having passed through the filter storage chamber 9 flows through the large and small circle portions of the through hole 29 and enters an upper portion of the fifth ink chamber 34 after having passed through the communication port 24A.

Next, the ink having flowed into the fifth ink chamber 34 flows into the differential pressure regulating valve storage chamber 33 after having passed through the ink-flow-path port 25A. As mentioned previously, the ink flows into the ink supply port 4 at predetermined negative pressure by opening and closing actions of the membrane valve 52.

The first ink chamber 11 is in communication with the atmosphere by way of the atmosphere communication paths 13, 13A, the through hole 67, the valve storage chamber 8, etc., and is maintained at the atmospheric pressure. Hence, there does not arise a hindrance to an ink flow, which would otherwise be caused by generation of negative pressure. Even if the ink stored in the first ink chamber 11 has reversely flowed into the recess 38, the ink-repellent gas permeable sheet 55 provided on the recess 38 maintains communication with the atmosphere, while preventing the flow-out of ink. Thus, it is possible to prevent clogging in the atmosphere communication groove 36, which would otherwise be caused when ink has flowed into the atmosphere communication groove 36 and solidified there.

As mentioned above, in the cartridge 1, the ink flow groove 35 and the like, and the atmosphere communication groove 36 are formed in the front surface of the container main body 2, and the openings of these grooves are sealed by the first film 75, thus constituting flow paths. Hence, there can be readily formed a container having comparatively complicated flow paths, such as ink flow paths and atmosphere communication paths. Therefore, designing and machining of a molding die are facilitated, thereby enabling lower-cost manufacture of an ink cartridge.

The embodiment has illustrated, while taking an example in which a columnar filter is used as the filter 7. However, the invention is not limited to that example. Filters of various sizes and shapes may be used, so long as the filters assume the shape of a block.

As has been described, according to an ink cartridge of the invention, a recess for ink and an atmosphere communication groove are formed in the front surface of a container, and an openings of the recess and the groove are sealed by a film, thereby constituting flow paths. Hence, there can be readily formed a container having comparatively complicated flow paths, such as an ink flow path and an atmosphere communication path. Therefore, designing and machining of a molding die are facilitated, thereby enabling lower-cost manufacture of an ink cartridge.

In addition, in FIG. 5, reference character A designates an example of an imaginary straight line that is substantially parallel to an insertion direction B of an ink cartridge to a recording apparatus and that defines first and second sides of the ink cartridge.

What is claimed is:

1. An ink cartridge having a differential pressure regulating valve mechanism disposed in a container and interposed between an ink storage chamber and an ink supply port, the cartridge comprising:

a valve storage chamber for storing the valve mechanism, the valve storage chamber having an opening in a front surface of the container;

a lid member located downstream of the valve storage chamber and having a first ink flow groove for defining a part of an ink flow path, the lid member closing the opening of the valve storage chamber;

a wall having a second ink flow groove, the first ink flow groove being located upstream of and leading to the second ink flow groove;

a film attached to the front surface of the container and a surface of the lid member, the film defining the part of the ink flow path in cooperation with the first ink flow groove of the lid member and the second ink flow groove of the wall, and fixing the lid member in place with respect to the front surface of the container.

2. The ink cartridge according to claim 1, wherein the ink flow path extends from the valve mechanism to the ink supply port.

3. The ink cartridge according to claim 1, wherein the first and second ink flow grooves are both substantially straight and a direction of flow along the first ink flow groove is substantially parallel to a direction of flow along the second ink flow groove.

4. The ink cartridge according to claim 1, wherein the lid member lies in a vertical plane with regard to an orientation of the ink cartridge when the ink cartridge has been mounted in a printer, and the first ink flow groove meets the second ink flow groove at a position which is below the midpoint of the lid member.

5. The ink cartridge according to claim 4, wherein the first ink flow groove meets the second ink flow groove at substantially a lowest point on the lid member.

6. An ink cartridge for use with an ink-jet recording apparatus, comprising:

a container storing ink therein, and having an ink supply port and a front outer surface;

a differential pressure regulating valve mechanism;

a valve storage chamber storing the differential pressure regulating valve mechanism and having an opening;

a lid member closing the opening of the valve storage chamber;

an ink flow recess located downstream of the differential pressure regulating valve mechanism and defining a portion of an ink flow path formed in the front outer surface of the container;

an atmosphere communication recess for defining an atmosphere communication path formed in the front outer surface of the container; and at least one film covering both an opening of the ink flow recess and an opening of the atmosphere communication recess in the front outer surface of the container so that the openings both are sealed by the at least one film, thereby defining the ink flow path with the ink flow recess and the atmosphere communication path with the atmosphere communication recess, the film fixing the lid member in place.

7. The ink cartridge according to claim 6, further comprising:

an over-sheet for covering the film, which is attached to the front surface of the container.

8. The ink cartridge according to claim 7, wherein the over-sheet has an extended region for covering a surface other than the front surface of the container.

9. The ink cartridge according to claim 8, wherein the extended region covers an ink injection port.

10. The ink cartridge according to any one of claim 6, 7, 8 or 9, wherein a thickness of the film is smaller than a thickness of the over-sheet.

11. The ink cartridge according to claim 6, further comprising:

a differential pressure regulating valve mechanism disposed in the container and interposed between an ink storage chamber of the container and the ink supply port, wherein:

the ink flow recess and the at least one film, define a part of an ink flow path extending from the valve mechanism to the ink supply port;

the atmosphere communication recess is a circuitous recess and with the at least one film defines a capillary communicating the ink storage chamber with the atmosphere.

12. The ink cartridge according to claim 11, wherein the at least one film comprises:

a first film attached to the front surface of the container to close openings of the ink flow recess and the circuitous recess, and a second film attached to the front surface of the container to be overlaid on the first film.

13. The ink cartridge according to any one of claim 6, 7, 8, 9, 11, or 12, wherein:

the ink flow recess is entirely located in a first portion of the front surface, and the atmosphere communication recess is entirely located in a second portion of the front surface opposite from the first portion with respect to an imaginary straight line.

14. The ink cartridge according to claim 13, wherein the imaginary straight line is substantially parallel to an insertion direction of the ink cartridge to a recording apparatus.

15. The ink cartridge according to claim 13, wherein the container has a valve storage chamber located in the first portion and the differential pressure regulating valve mechanism is stored in the valve storage chamber.

16. An ink cartridge as in claim 15, wherein the front outer surface has a plurality of raised ribs formed thereon, and the film is attached to at least some of said raised ribs.

17. The ink cartridge according to claim 13, wherein the container has a chamber that is sealed by an air permeable and ink repellent sheet, that communicates via the sheet with the atmosphere communication recess, and that is located in the second portion.

18. The ink cartridge according to claim 13, wherein:

the film is welded to the front surface of the container and the film has a first region which is formed with a predetermined welding height and a second region which is formed with a predetermined welding strength; and the first and second regions correspond to the second and first portions, respectively.

19. The ink cartridge according to claim 13, further comprising:

a groove which does not constitute a flow path is formed in the front surface of the container, and is located at a boundary between the first and the second regions.

20. An ink cartridge having a differential pressure regulating valve mechanism disposed in a container and interposed between an ink storage chamber and an ink supply port, the cartridge comprising:

a valve storage chamber for storing the valve mechanism, the valve storage chamber having an opening in a front surface of the container;

a lid member located downstream of the valve storage chamber and having a first ink flow groove for defining a part of an ink flow path, the lid member having a shape corresponding to a shape of the opening of the valve storage chamber and fitting into and closing the opening of the valve storage chamber;

a wall having a second ink flow groove, the first ink flow groove being located upstream of and leading to the second ink flow groove; and a film attached to the front surface of the container and a surface of the lid member, the film defining the part of the ink flow path in cooperation with the first ink flow groove of the lid member and the second ink flow groove of the wall, and fixing the lid member in place with respect to the front surface of the container, wherein the first and second ink flow grooves are both substantially straight and a direction of flow along the first ink flow groove is substantially parallel to a direction of flow along the second ink flow groove.

21. An ink cartridge having a differential pressure regulating valve mechanism disposed in a container and interposed between an ink storage chamber and an ink supply port, the cartridge comprising:

a valve storage chamber for storing the valve mechanism, the valve storage chamber having an opening in a front surface of the container;

a lid member located downstream of the valve storage chamber and having a first ink flow groove for defining a part of an ink flow path, the lid member having a shape corresponding to a shape of the opening of the valve storage chamber and fitting into and closing the opening of the valve storage chamber;

a wall having a second ink flow groove, the first ink flow groove being located upstream of and leading to the second ink flow groove so that the first ink flow groove meets the second ink flow groove at a position which is below the midpoint of the lid member; and a film attached to the front surface of the container and a surface of the lid member, the film defining the part of the ink flow path in cooperation with the first ink flow groove of the lid member and the second ink flow groove of the wall, and fixing the lid member in place with respect to the front surface of the container.

22. An ink cartridge for use with an ink-jet recording apparatus, comprising:

a container storing ink therein, and having an ink supply port and a front outer surface;

an ink flow recess defining a portion of an ink flow path formed in the front outer surface of the container;

an atmosphere communication recess for defining an atmosphere communication path formed in the front outer surface of the container the atmosphere communication recess having a portion lying in a plane of the front outer surface of the container;

an ink trap recess formed in the front outer surface and having a perimeter, the atmosphere communication recess being in fluid communication with the perimeter;

at least one film covering both an opening of the ink flow recess, an opening of the atmosphere communication recess and the ink trap recess in the front outer surface of the container so that the openings and the ink trap recess are sealed by the at least one film, thereby defining the ink flow path with the ink flow recess, the atmosphere communication path with the atmosphere communication recess, and an ink trap.

23. An ink cartridge as in claim 22, further comprising:

a raised frame located within the perimeter of the ink trap recess; and a trap film made of material which is at least one of air permeable and liquid impermeable and which is attached to the raised frame.

24. An ink cartridge as in claim 23, wherein the trap film and the film are not in contact.

25. An ink cartridge for use with an ink-jet recording apparatus, comprising:

a container storing ink therein, and having an ink supply port and a front outer surface;

a valve chamber formed in the front outer surface, the valve chamber having an open end;

a membrane valve contained within the valve chamber;

a lid at least partially closing the open end of the valve chamber, an atmosphere communication recess for defining an atmosphere communication path formed in the front outer surface of the container the atmosphere communication recess having a portion lying in a plane of the front outer surface of the container;

an ink trap recess formed in the front outer surface and having a perimeter, the atmosphere communication recess being in fluid communication with the perimeter;

at least one film covering the lid, an opening of the atmosphere communication recess and the ink trap recess in the front outer surface of the container so that the lid is fixed in place, and the atmosphere communication recess and the ink trap recess are sealed by the at least one film, thereby defining the atmosphere communication path with the atmosphere communication recess, and an ink trap.

26. An ink cartridge as in claim 25, further comprising:

a raised frame located within the perimeter of the ink trap recess; and a trap film made of material which is at least one of air permeable and liquid impermeable and which is attached to the raised frame.

27. An ink cartridge as in claim 26, wherein the trap film and the film are not in contact.

* * * * *